United States Patent [19]

Tye

[11] 4,312,262

[45] Jan. 26, 1982

[54] RELATIVE VELOCITY GUNSIGHT SYSTEM AND METHOD

[75] Inventor: Gene Tye, Endwell, N.Y.

[73] Assignee: General Electric Company, Binghamton, N.Y.

[21] Appl. No.: 13,977

[22] Filed: Feb. 22, 1979

[51] Int. Cl.[3] ..... F41G 3/22

[52] U.S. Cl. ..... 89/41 EA; 235/412; 356/29; 364/423

[58] Field of Search ..... 33/238, 239; 89/41 EA; 235/411, 412; 356/29, 152, 251, 252; 358/93, 125, 126, 250; 364/423, 516

[56] References Cited

U.S. PATENT DOCUMENTS

| | | | |
|---|---|---|---|
| 2,467,831 | 4/1949 | Johnson | 33/238 |
| 2,957,245 | 10/1960 | Kimble | 33/238 |
| 2,957,384 | 10/1960 | Raninen | 356/252 |
| 2,979,711 | 4/1961 | Shelley | 356/252 |
| 3,024,536 | 3/1962 | Kuhlenkamp | 33/238 |
| 3,059,338 | 10/1962 | Coetaux | 356/29 |
| 3,137,769 | 6/1964 | Yates et al. | 358/93 |

OTHER PUBLICATIONS

"The Harrier Navigation/Attack System", Aircraft Engineering, Mar. 1970, pp. 15–18, 20–21.

*Primary Examiner*—Stephen C. Bentley
*Attorney, Agent, or Firm*—Arthur E. Bahr; Irving M. Freedman; Ralph M. Savage

[57] ABSTRACT

A system and method for providing a relative velocity sighting reference in an airborne gunsight system. A head-up display (HUD) frames the target in the pilot's line of sight and a computer-driven cathode ray tube (CRT) display projects an array of sighting indices or dots on the HUD. The computer receives air data and target tracking inputs and controls the CRT display so that the sighting array automatically overlays and follows the target and so that the indices thereof move in a direction and at a velocity to describe the motion of the line of sight of the target required for the target to intercept a bullet fired from the aircraft gun. The pilot maneuvers the aircraft to null the relative motion between the target and the sighting indices, whereby the gun is in position to fire.

14 Claims, 18 Drawing Figures

RELATIVE VELOCITY GUNSIGHT SYSTEM AND METHOD

BACKGROUND OF THE INVENTION

This invention relates to gunsight systems for controlling an airborne gun platform for air-to-air gunnery which is particularly applicable, but not necessarily restricted to, controlling gunfire in air superiority fighter aircraft.

The state of the art in aircraft gunsight systems has remained relatively unchanged since the 1940's and 1950's and has typically been based on implementation of the so-called "LCOS" (Lead Computing Optical Sight) system. An example of an LCOS system is described in U.S. Pat. No. 2,467,831 issued to F. V. Johnson in 1949.

This type of system provides the pilot of the aircraft with a reticle (sometimes also called a "pipper") image on an optical head-up display (HUD) panel. Through use of collimating optics in the sight system, the image of the reticle is made to appear at infinity in the pilot's field of view. The position of the reticle on the display panel is controlled by a two-axis gyro in a manner which is dependent on the angular velocity of the line of sight to the target and the projectile time of flight to the target. Operation of the LCOS system generally requires the pilot to maneuver the attacking aircraft so that the reticle is near the target for some minimum time. At the same time, an accurate estimate of the range of the target aircraft has to be entered into the system.

When the target is being "tracked" by the LCOS reticle and an accurate target range input is available, the attacking aircraft is properly oriented so that the muzzle velocity vector of its gun (appropriately compensated for gravity drop) is in the turning plane of the target and is offset at the correct lead angle. Firing of the gun at this time maximizes the likelihood of achieving a hit on a target.

The relationship between the various system parameters which is necessary to obtain a hit is the following:

$$\bar{\lambda} = T_n\dot{\bar{\beta}} + \frac{(\bar{a}_n + \bar{a}_r) \times \bar{S}}{2V_f} \cdot T_f + f_b(V_b, \alpha, T_f)\bar{\alpha}_g \quad (1)$$

where $\bar{\lambda}$ = vector lead angle (for $\sin\lambda \cong \lambda$)
$T_n$ = sensitivity time ≅ time of flight
$T_f$ = time of flight
$\dot{\bar{\beta}}$ = angular rate of line of sight to target
$\bar{a}_r$ = target acceleration relative to own aircraft acceleration
$\bar{a}_n$ = own aircraft lift acceleration
$V_f$ = average velocity of a bullet relative to own aircraft
$\bar{S}$ = unit vector along the line of sight
$f_b$ = ballistic curvature function as exemplified in the second term on the right side of equation (13)
$V_b$ = bullet initial velocity
$\alpha$ = aircraft angle of attack
$T_f$ = bullet time of flight
$\alpha_g$ = gun angle of attack.

The lead computing optical sight (LCOS) does not have a target angle tracker and therefore implements equation (1) by developing a line of sight rate as the dependent variable, i.e.,:

$$\dot{\bar{\beta}} = \frac{\bar{\lambda}}{T_n} - \frac{(\bar{a}_n + \bar{a}_r) \times \bar{S}}{2V_f} \frac{T_f}{T_n} - f_b(V_b, \alpha, T_f)\alpha_g \quad (1a)$$

The lead angle, $\bar{\lambda}$, in this case is the angle between the gun and the reticle and is equal to the target line of sight angle only if the pilot tracks the target. Excessive time is frequently required for the pilot to "settle" the reticle near enough to the target to be a useful reference in highly transient gun attacks.

Fire control systems which have attempted to mechanize equation (1) by measuring the angular rate of the line of sight to the target, $\dot{\bar{\beta}}$, with an independent tracking device (e.g. radar) and then compute the required lead angle have been called "director systems."

A critical limitation of this type of system has been the lack of accuracy of measurement of the $\dot{\bar{\beta}}$ parameter by means of the tracking subsystem. Available trackers are extremely vulnerable to target-generated noise, e.g., motion of the tracker across the target due to changes in contrast, and other noise sources such as background clutter, wave front interference effects, and the like. These phenomena are typically in the same spectral region as the actual target maneuvers being tracked, and therefore are difficult to separate by filtering techniques. For example, in the case of an electro-optical or radar tracker following a specific reflection from the target, a sudden change in target attitude will cause a sudden change in the position of the reflection, e.g., from one wing tip to the other, and the tracker will respond by generating a false indication of a rapid change in the angular velocity of the target.

Because the director system displays the reticle in terms of vector lead angle ($\bar{\lambda}$) pursuant to the above equation, the rate of change $\dot{\bar{\beta}}$ of the target line of sight magnifies the effect of such false tracking outputs such that the displayed reticle is very unstable. In other words, because the system responds to the rate of change of tracking noise, it is very difficult for the pilot to achieve solid registration of the pipper on the target for the amount of time necessary to ensure accurate firing. The pilot of the target aircraft is able to capitalize on this flaw in the system by performing evasive maneuvers which enhance the amount of the noise introduced into the tracking system.

The system of the present invention eliminates the first order effects of target noise by presenting the pilot with an angle rate display based on measured target angle, rather than an angle display based on measured target angular rate.

OBJECTS AND SUMMARY OF THE INVENTION

Accordingly, it is an object of the present invention to provide an improved air-to-air gunsight system and method which eliminates the first order effects of tracking noise.

A further object is to provide an improved air-to-air gunsight system which presents the pilot with a sighting index which is always presented either directly on, or in the immediate vicinity of, the target as viewed in the head-up display.

Still a further object is to provide a system of the type described in which erratic, sudden movements of the sighting index or reticle are eliminated.

Another object of the invention is to provide a system of the type described which is as accurate or more accurate than current gunsight director systems but which can be implemented by simpler, less complex, and more reliable target tracking devices.

Additional objects and advantages of the invention will be set forth in part in the description which follows, and in part will be apparent from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the system of the invention implements a system and method for aiming the gun of an aircraft utilizing a head-up display including the steps of, and means for, aligning a target in the field of view of the head-up display, projecting a sighting index on the head-up display such that the index describes the line of sight of a hypothetical target located at the same range and position as the target and travelling at the velocity and in the direction required to intercept, one bullet flight time later, a bullet fired from the aircraft gun, comparing the velocity of the sighting index relative to the velocity of the target in the head-up display, and maneuvering the aircraft to null the relative velocity between the index and the target such that the aircraft gun is positioned at the correct lead angle.

In accordance with a further aspect of the invention, as embodied and broadly described herein, the system implements a method for controlling the gunfire of an aircraft utilizing a head-up display including the steps of tracking a target located in the field of view of the display to determine the position of the target relative to the aircraft and to generate position signals describing the target position, projecting a sighting index on the display at a location thereon coincident with the target as viewed in the display, and controlling the position of the sighting index on the display to move it in accordance with the equation:

$$\dot{\bar{\beta}} = \frac{\bar{\lambda}'}{T_n} - \frac{a_n \times \bar{S}}{2V_f'} \qquad (2)$$

where $\dot{\bar{\beta}}$ = angular rate of the line of sight represented by said sighting index $\bar{\lambda}'$ = position of said target as represented by said position signals $T_n$ = bullet time of flight $\bar{a}_n$ = own aircraft acceleration $\bar{S}$ = unit vector along line of sight $V_f'$ = approximate average bullet relative velocity with respect to own aircraft whereby the sighting index describes the angular velocity of the line of sight to a hypothetical target located at the range of the actual target and for which $\bar{\lambda}'$ is the correct lead angle.

In accordance with a further aspect of the invention, as embodied and broadly described herein, an optical gunsighting system is provided for an aircraft including, in combination, a sighting panel presenting a field of view, including a target, to a gun operator, means for generating inertial data signals describing the motion of the aircraft, including roll rate, pitch rate, yaw rate and lift acceleration, means for tracking the target and for generating target data signals, including signals describing the range and relative position of the target with respect to the aircraft, display means for presenting a sighting index on the sighting panel superimposed on the field of view thereof, and control means responsive to the inertial and target data signals for controlling the operation of the display means such that the index is presented in a position on the panel which is close to the target and which moves on the panel at a velocity and in a direction describing the motion of the line of sight of the target required for the target to intercept a bullet fired from the aircraft gun.

BRIEF DESCRIPTION OF THE DRAWINGS

The accompanying drawings, which are incorporated in and constitute a part of this specification, illustrate an embodiment of the invention and, together with the description, serve to explain the principles of the invention.

FIGS. *6a–6f* are flow diagrams illustrating the functions performed by the computer 30 in implementing the system and method of the invention.

Figure 5:
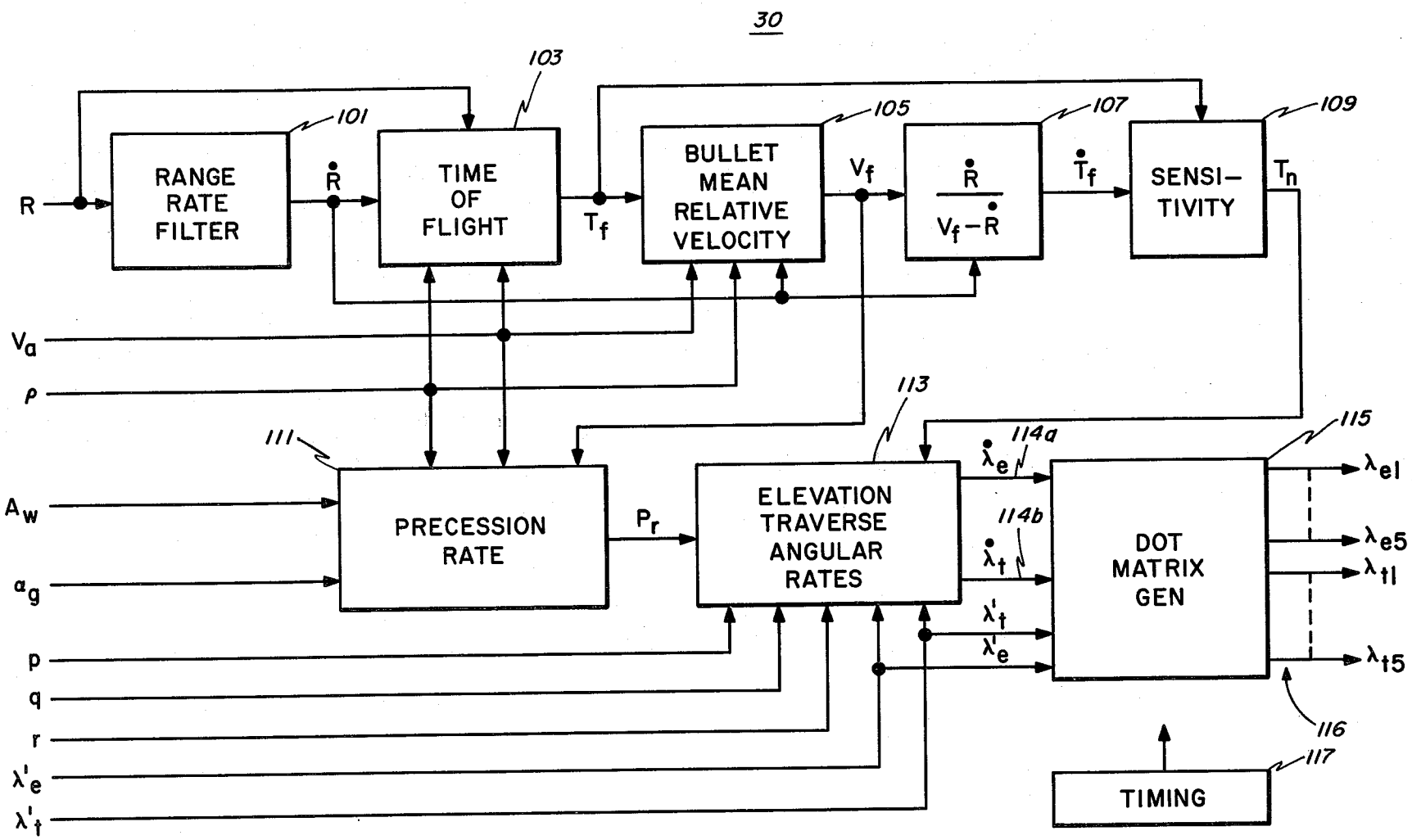
FIG. 5 is a schematic diagram showing the principal components of the computer 30 of FIG. 1.
Figure 7:
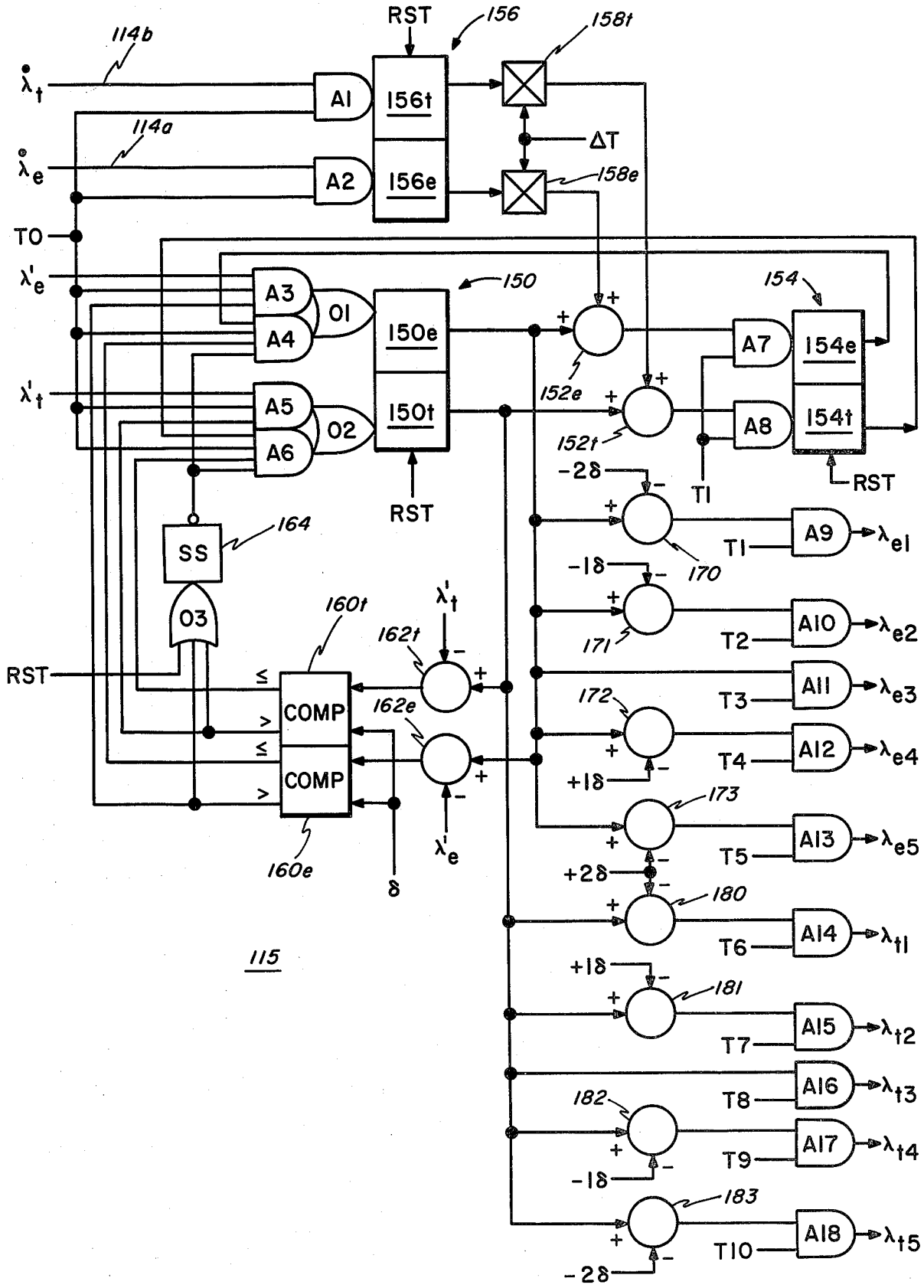

FIG. 7 is a schematic diagram illustrating the circuits utilized in a hardware implementation of the dot matrix generator 115 of FIG. 5.

Figure 8:
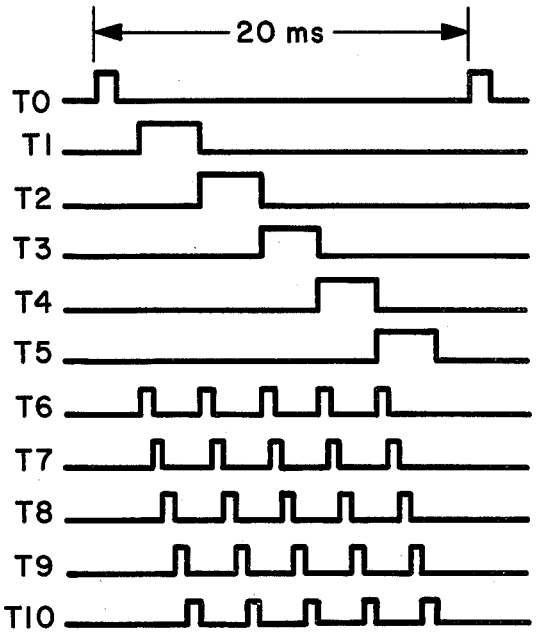

FIG. 8 is a timing diagram showing the timing signals T0–T10 used in connection with the operation of the dot matrix generator of FIG. 6.

Figure 9:
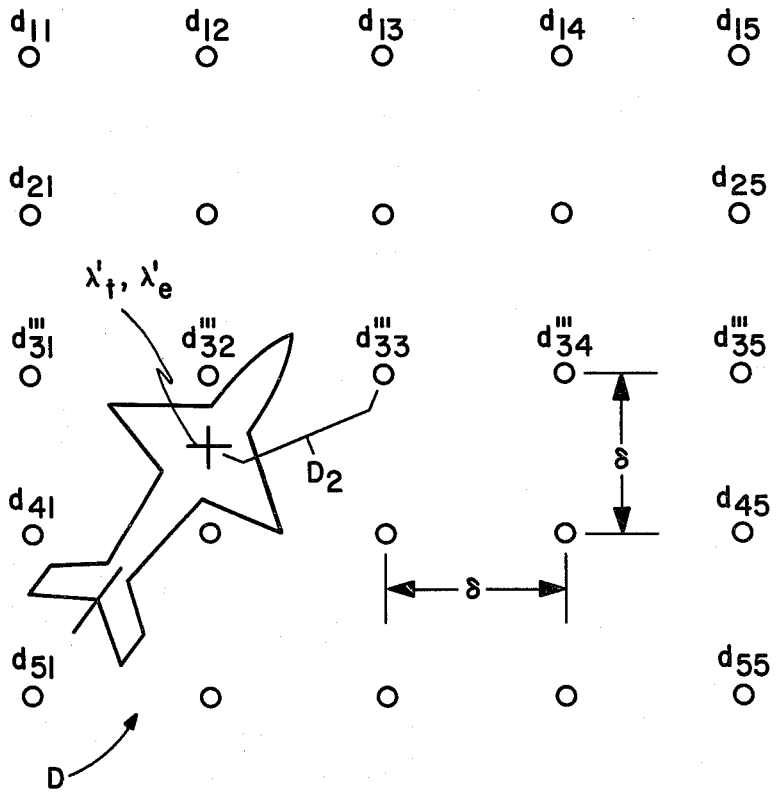

FIG. 9 is a schematic diagram illustrating the individual sighting indices of the sighting array at a time when the center index or dot $d_{33}$ is at a distance $D_2$ from the target as viewed in the head-up display.

FIGS. *10a–10d* are diagrams depicting the manner in which the central sighting index $d_{33}$ of the sighting array is controlled in accordance with the principles of the invention.

DETAILED DESCRIPTION OF PREFERRED EMBODIMENT

Reference will now be made in detail to the present preferred embodiment of the invention, an example of which is illustrated in the accompanying drawings.

Figure 1:
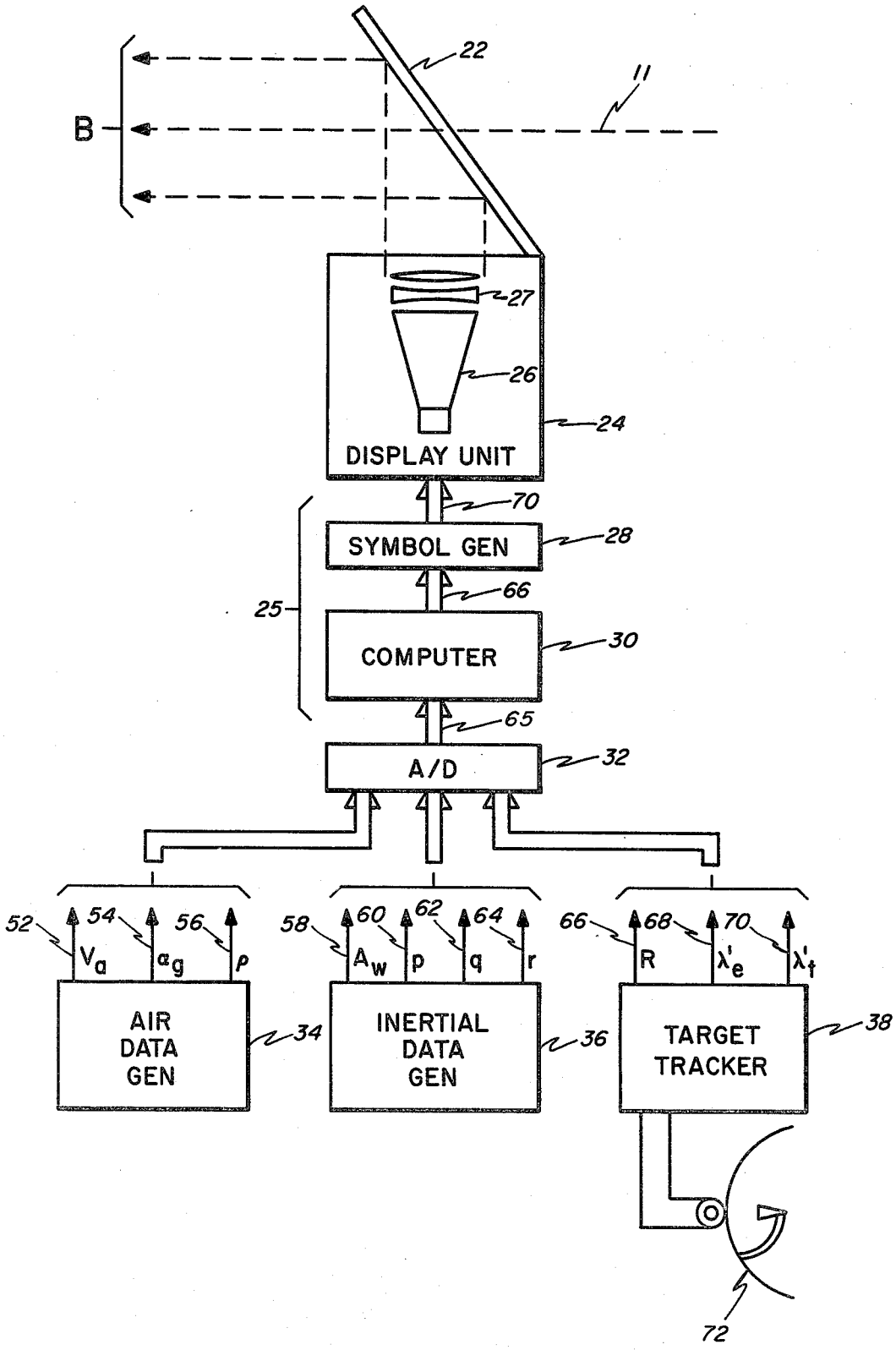
FIG. 1 is a schematic diagram illustrating the principal components of the system of the invention.

FIG. 1 shows, in block diagram form, the gun sighting system in accordance with a preferred embodiment of the invention. The pilot (gun operator) located at B is presented with a field of view, including the target, through a combining glass panel 22 arranged in accordance with a conventional "head-up display" (HUD) configuration. The pilot's field of view includes the line of sight 11 to the target.

A sight display unit 24, including a cathode ray tube (CRT) 26 and collimating optics 27, operates to project sighting indices onto the pilot's field of view via the combining glass 22. The collimating optics 27 serve to focus the images of the indices so that they appear to the pilot to be emanating from infinity i.e., from the area of the target. This collimating arrangement is well known in connection with HUD systems and operates to eliminate parallax problems and permits the pilot the freedom to move his head within the sight field of view without degrading the accuracy of the system.

The display unit 24 projects sighting indices in accordance with control signals received from a control unit 25 including a symbol generator 28 and a digital computer 30. The latter receives inputs through an analog-to-digital converter unit 32 from a plurality of data input sources 34, 36, and 38.

Air data generator 34 supplies signals to A/D unit 32 over lines 52, 54, and 56 representing, respectively, own aircraft true airspeed $V_a$, gun angle of attack $\alpha_g$, and relative air density $\pi$, respectively. These signals are encoded by A/D converter unit 32 and fed to computer 30 via data bus 65.

An inertial data generator 36 supplies signals representing own aircraft lift acceleration $A_w$, roll rate p, pitch rate q, and yaw rate r on lines 58, 60, 62, and 64, respectively. These signals are also encoded by A/D converter 32 and fed to computer 30 over data bus 65.

A target tracking subsystem 38, employing, for example, a radar unit 72 for tracking the target defined by line of sight 11, supplies the further signals representing target range R, target elevation angle $\lambda_e'$ (relative to own aircraft), and target traverse angle $\lambda_t'$ on lines 66, 68, and 70, respectively. These signals are also encoded by A/D converter 32 and fed to computer 30 via data bus 65.

The computer 30 receives the ten aforementioned digitally encoded input signals and processes them in accordance with prescribed mathematical procedures to be described hereinafter and feeds signals through symbol generator 28 and via output bus 70 to operate the beam deflection and control amplifiers of the display unit 24 whereby an array of sighting indices is displayed on the face of the CRT 26 and projected by optics 27 to the HUD combining glass panel 22.

Figure 2:
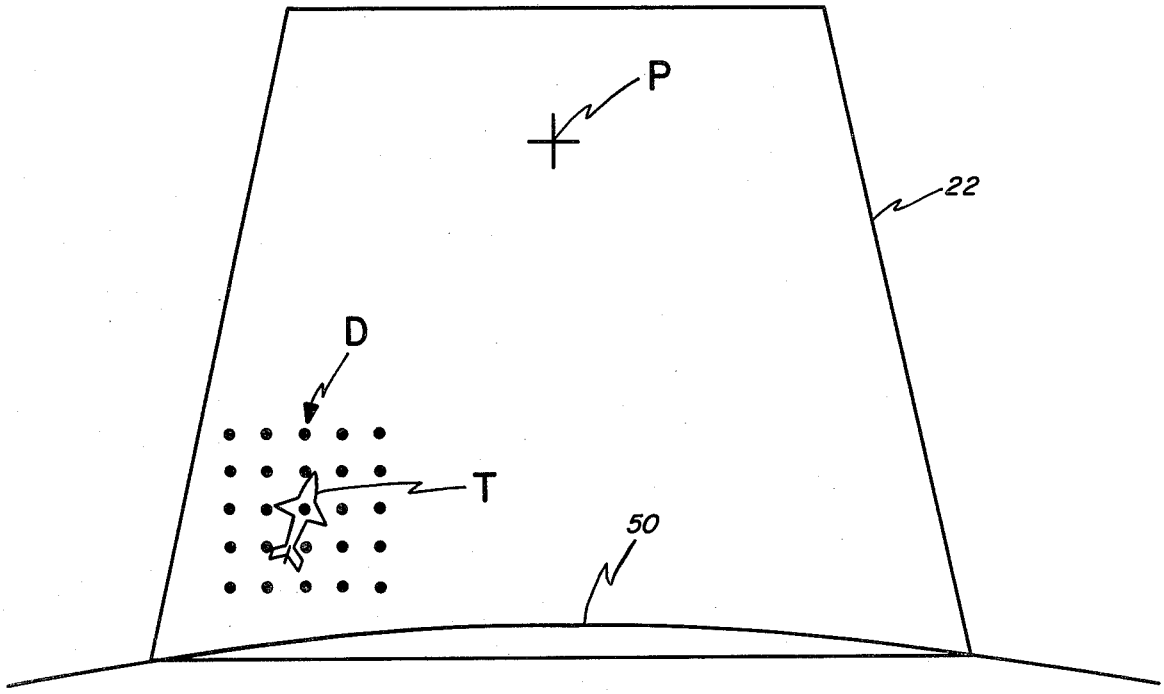
FIG. 2 is a diagram illustrating the head-up display as viewed by the pilot of the attacking aircraft, including the presentation thereon of a matrix of sighting indices displayed superimposed on the target image in accordance with the invention.
Figure 3:
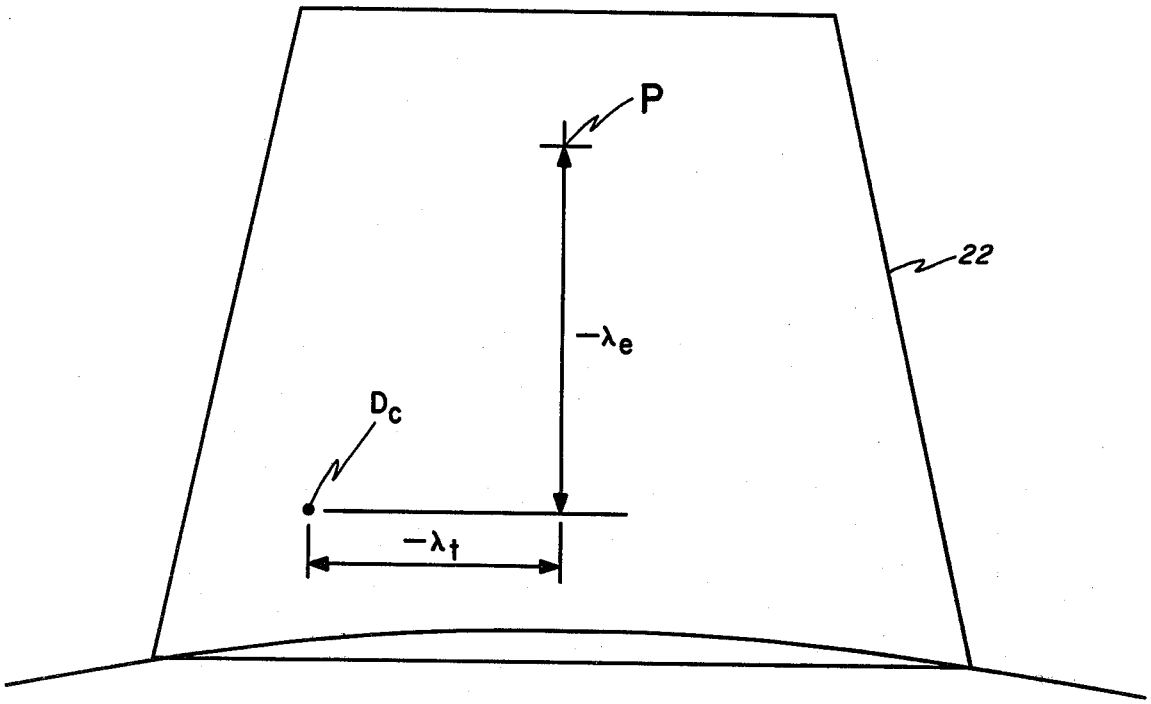
FIG. 3 is a diagram illustrating the position of the center sighting index of the index array in terms of its traverse and elevation display coordinates, $\lambda_t$ and $\lambda_e$, respectively.

FIG. 2 illustrates the field of view presented to the pilot through the combining glass 22. The pilot views the target T together with an array of sighting indices, shown in FIG. 2 as a five-by-five matrix or field of dots D superimposed on target T. The field of view extends forward over the nose 50 of the aircraft. The cross P shown on the display represents the muzzle boresight or aiming point. This is the point where the gun muzzle velocity vector intersects a plane located a predetermined distance in front of the aircraft. As described hereinafter, the position of the individual sighting indices in the field or array D is defined in terms of display coordinates $\lambda_e$ and $\lambda_t$ which are referenced from the point P. As shown in FIG. 3, the center dot $D_c$ of the sighting array has its position defined by the elevation coordinate $-\lambda_e$ and the traverse coordinate $-\lambda_t$.

Figure 4:
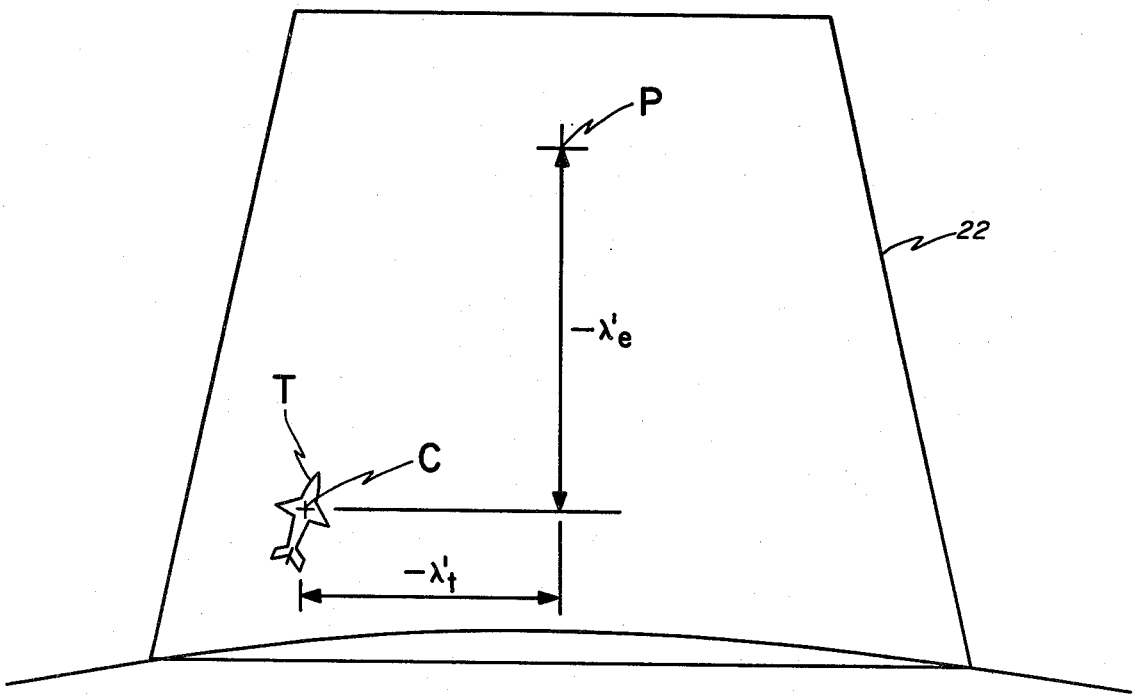
FIG. 4 is a diagram illustrating the tracking coordinates of the target in terms of the traverse and elevation display coordinates $\lambda_t'$ and $\lambda_e'$, respectively.

The position of target T relative to the display 22 is similarly defined in terms of an elevation coordinate $-\lambda_e'$ and a traverse coordinate $-\lambda_t'$, shown in FIG. 4. The latter parameters are determined by the output signals of like designation generated on output lines 68 and 70 of target tracker 38. The coordinates $\lambda_e'$ and $\lambda_t'$ therefore define, in display coordinates, the position of the point C relative to reference point P. Point C is the point which the tracking radar theoretically detects as the center of the target T. The point C, as has been discussed previously, may or may not be the actual center of the target and may fluctuate somewhat erratically due to target tracking noise and other disturbances.

As will be described hereinafter, the system of the invention operates to maintain the sighting array D superimposed on the target observed through the sighting panel 22 so that at least one of the several sighting indices or dots of the array is always viewed as directly overlaying, or very near to, some part of the target. As the target moves with respect to the field of view, the dot field D follows it in a manner similar to the manner in which the target designating marker in present air-to-air gunfire director systems follows a selected target.

However, the individual dots move within the dot field D according to an equation described below to provide the pilot with an indication of gun error whereby the pilot has only to observe the relative motion of the target and a dot in the array to effectively aim the aircraft gun or guns. The motion of the dots defines the angular velocity of the line of sight of a hypothetical target for which the actual target coordinates $-\lambda_e'$ and $-\lambda_t'$ represent the correct lead angle.

To appreciate the improvement obtained via the sighting system of the invention, the effect of tracking noise must first be understood. Implementation of the prior art systems through previously stated equation (1) requires calculation and display of the correct lead angle $\bar{\lambda}$ as a function of the angular velocity of the target line of sight. Equation (1) can be stated in simplified form as:

$$\bar{\lambda}=T_n\dot{\bar{\beta}} \tag{3}$$

Tracking noise is manifested as a component of the measured target line of sight. The noise component is expressed in the context of equation (3) as follows:

$$\bar{\lambda}=T_n(\dot{\bar{\beta}}+\dot{\bar{N}}) \tag{4}$$

where $\dot{\bar{\beta}}$ represents the angular rate of the actual target line of sight and $\dot{\bar{N}}$ represents the angular rate of the noise component.

From equation (4) it can be seen that the effect of tracking noise is amplified in the output display of lead angle $\bar{\lambda}$ since the rate of change of the noise component is utilized in the lead angle calculation. Display of the lead angle in the sighting system via the positioning of the sighting pipper or reticle is therefore also a function of the rate of change of the noise. Since the noise component is subject to very rapid fluctuation, e.g., when the target tracker shifts across the target image due to a sudden change in contrast, sun angle, wave front interference effects, background clutter, etc., the rate of the noise component can momentarily become very high. This will cause discontinuance (sudden movement of the sighting reticle) which is confusing and distracting to the pilot and which can prevent effective performance of the system.

The system of the invention eliminates this deficiency and provides a far more effective sighting display by measuring $\bar{\lambda}$, rather than $\dot{\bar{\beta}}$, and by solving the gunfire control equation for $\dot{\bar{\beta}}$, rather than $\bar{\lambda}$. The sighting display presented to the pilot is thus a relative velocity or rate display rather than an angle display. Simplified, the gunfire control equation implemented by the present system is:

$$\dot{\bar{\beta}} = \frac{\bar{\lambda}'}{T_n} \tag{5}$$

where $\bar{\lambda}'$ is the present measured angular position of the target with respect to the attacking aircraft. $\bar{\lambda}'$ is the basic output of the target tracker. The displayed rate therefore represents the motion which the target line of sight must follow when the lead angle is the present measured target angle.

Inserting the noise component into equation (5) yields the following:

$$\dot{\bar{\beta}} = \frac{(\bar{\lambda}' + \bar{N})}{T_n} \tag{6}$$

Equation (6) reveals that only the magnitude, not the rate, of the tracking noise affects the accuracy of the system. Noise thus does not have a first order impact and does not introduce a visually noticeable change in the position or movement of the sighting index or reticle. In fact, since the noise component does not usually shift the measured target angle outside the bounds of the target outline or outer dimensions, the measured value of $\bar{\lambda}'$ is usually correct for some part of the target even with the noise component present. It thus can be seen that the system of the invention is virtually unaffected by tracking noise. This is highly advantageous because it enables the system to be implemented with a less expensive, lower tolerance type of tracking unit.

Development of the gunfire control equation utilized in the invention can be demonstrated by solving the basic LCOS equation (1) with $\bar{\beta}$ as the dependent variable:

$$\dot{\bar{\beta}} = \frac{\bar{\lambda}'}{T_n} - \frac{(\bar{a}_n + \bar{a}_r) \times \bar{S} \cdot T_f}{2V_f' \cdot T_n} - \frac{f_b(V_b, \alpha, T_f)\bar{\alpha}_g}{T_n} \tag{7}$$

where $\bar{\lambda}'$ is the measured target angle.

To facilitate implementation, the third term of equation (7) can be ignored since its contribution to $\dot{\bar{\beta}}$ is small. Similarly, $\bar{\alpha}_r$ can be assumed to be zero and $T_f/T_n$ can be set at unity. Thus simplified, equation (7) is restated as:

$$\dot{\bar{\beta}} = \frac{\bar{\lambda}'}{T_n} - \frac{\bar{a}_n \times \bar{S}}{2V_f'} \tag{8}$$

where $V_f'$ is taken as a value of average bullet relative velocity somewhat larger than the actual value to compensate for the elimination of the third term of equation (7). Using equation (8) as the basic algorithm, the computer 30 of the FIG. 1 system generates the signals necessary to control the CRT 26 of display unit 27 to cause the sighting indices or dots of the array D (FIG. 2) to move at a velocity and in a direction which defines $\dot{\bar{\beta}}$.

Utilizing this display, the pilot meneuvers the aircraft to null the velocity of the target relative to a dot of the array D. Since a plurality of closely spaced dots is provided, there will always be at least one dot overlaying or very near to the target so that an accurate rate comparison can be made by visual observation. The pilot manuevers the aircraft until he observes a sighting dot in a fixed position relative to the target image. This condition indicates zero gun error and signals proper gun alignment so that firing can be initiated.

Implementation of equation (8) via computer 30 requires conversion of the terms of the equation to aircraft coordinates. This yields the following:

$$-\dot{\lambda}_t = K\left(r + \frac{\lambda_t'}{T_n}\right) - p\lambda_e' \tag{9}$$

$$-\dot{\lambda}_e = K\left(q + \frac{\lambda_e'}{T_n} + P_r\right) + p\lambda_t' \tag{10}$$

where:

| | |
|---|---|
| $\dot{\lambda}_t$ and $\dot{\lambda}_e$ | are the transverse and elevation display coordinates defining $\dot{\bar{\beta}}$; |
| K | is a constant less than 1 and greater than 0.67; |
| r,p, and q | are the measured yaw rate, roll rate, and pitch rate of the aircraft; |
| $\lambda_t'$ and $\lambda_e'$ | are the traverse and elevation angles of the target line of sight as measured by the target tracker; |
| $T_n$ | is the sensitivity calculated according to the equation |

$$T_n = \frac{T_f}{1 + C_t T_f} \tag{11}$$

where:

| | |
|---|---|
| $C_t$ = | constant = 0.5 and $T_f$ = predicted bullet time of flight; |
| $T_f$ | is obtained from solution of the following quadratic equation: |

$$k_o\rho\,(\dot{R} + V_a)\sqrt{V_m}\left(1 + \frac{V_a}{2V_m}\right)T_f^2 - \left[V_m - \dot{R} - k_o\rho R\sqrt{V_m}\left(1 + \frac{V_a}{2V_m}\right)\right]T_f + R = O \tag{12}$$

where:

| | |
|---|---|
| R = | present target range |
| $k_o$ = | ballistic constant = 0.00625 |
| $\rho$ = | relative air density |
| $V_a$ = | aircraft true airspeed |
| $V_m$ = | muzzle velocity — 3300 fps; and |

Pr is precession rate calculated as follows:

$$Pr = \frac{A_w}{2V_f} - \frac{k_o}{\sqrt{V_m}\left(1 + \frac{V_a}{2V_m}\right)}\rho V_a \alpha_g \tag{13}$$

where:

| | |
|---|---|
| $A_w$ = | lift acceleration |
| $\alpha_g$ = | gun angle of attack |

$$V_f = V_m - k_o\rho\,[R + (\dot{R} + V_a)T_f]\sqrt{V_m}\left(1 + \frac{V_a}{2V_m}\right) \tag{14}$$

FIG. 5 illustrates the circuits of computer 30 which operate to receive the ten basic input signals from input units 34, 36, and 38 via analog-to-digital converter 32. The input lines shown to the left of FIG. 5 represent the ten digitized output signals presented to the computer on A/D output bus 65 (FIG. 1). Computer 30 comprises circuits arranged to implement equations (9) and (10) to periodically generate the angular rate values $\dot{\lambda}_t$ and $\dot{\lambda}_e$ for use in controlling the motion of the displayed sighting dots.

Circuit 101 is a conventional range rate filter producing a range rate signal $\dot{R}$ in response to the range signal R received from the target tracker. Circuit 103 responds to input signals R, $\dot{R}$, $V_a$, and $\rho$ to generate a signal $T_f$ representing the predicted bullet time of flight in accordance with the solution to the above quadratic equation (12). Circuit 105 implements equation (14) in response to $T_f$, $V_a$, $\rho$, and $\dot{R}$ to generate a signal $V_f$ representing bullet mean relative velocity. Circuit 107 calculates $\dot{T}_f$ in accordance with the equation $R/(V_f-R)$ and circuit 109 receives the $\dot{T}_f$ output from circuit 107 and the $T_f$ output from circuit 103 and produces a sensitivity signal $T_n$ in accordance with equation (11).

Circuit 111 calculates a precession rate signal $P_r$ in response to the inputs $A_w$, $\alpha_g$, $\rho$, $V_a$, and $V_f$. Circuit 111 implements equation (13). Finally, circuit 113 implements equations (9) and (10) in response to the $P_r$ and $T_n$ signals along with the p, q, r, $\lambda_e'$, and $\lambda_t'$ inputs. The angular rate display coordinate signals $\dot{\lambda}_e$ and $\dot{\lambda}_t$ appear on output lines 114*a* and 114*b*, respectively, from circuit 113. A timing circuit 117 controls the operation of the circuits of computer 30 such that output signals $\dot{\lambda}_e$ and $\dot{\lambda}_t$ are periodically made available on the lines 114*a* and 114*b*.

A dot matrix generator 115 responds to the timing signals and to the signals on lines 114*a* and 114*b*, as well as to the target angle signals $\lambda_t'$ and $\lambda_e'$ received from target tracker 38 to periodically produce a set of ten display coordinate signals $\lambda_{e1}-\lambda_{e5}$ and $\lambda_{t1}-\lambda_{t5}$ on output lines 116. The signals $\lambda_{e1}-\lambda_{e5}$ represent the elevation coordinates for the five rows of dots in the sighting array D and the $\lambda_{t1}-\lambda_{t5}$ signals represent the traverse coodinates for the five vertical columns of dots in the array (see FIG. 9). These signals are emitted in a timed sequence to control the symbol generator 28, whereby the beam of CRT 26 is repeatedly deflected through an appropriate scan pattern for generating the twenty-five dot sighting array.

The circuits shown in FIG. 5 can be fabricated from appropriate hardware components adapted to perform the mathematical operations called for by the equations which govern their operation. Alternatively, a general purpose computer can be programmed to carry out the necessary calculations to derive the required dot coordinate signals $\lambda_{e1}-\lambda_{e5}$ and $\lambda_{t1}-\lambda_{t5}$. FIGS. 6*a*–6*f* are flow diagrams defining such a computer control program.

Before describing the program flow diagrams, however, the following Table of Definitions identifies the various program terms set forth therein (Column A) and denotes (Column B) the equivalent term or symbol employed in the preceding mathematical descriptions of the system:

Table Of Definitions

| A | B | |
|---|---|---|
| XPOS | $\lambda_{t3}$ | x coordinate of center dot on display |
| YPOS | $\lambda_{e3}$ | y coordinate of center dot on display |
| DELTA | $\delta$ | spacing of dots on display (mradians) |
| TFMIN | — | minimum bullet time of flight when target is in range lock-on (sec) |
| TFMAX | — | maximum bullet time of flight when target is in range lock-on (sec) |
| ELIM | — | maximum range error for bullet time of flight solution (feet) |
| CT | $C_t$ | sensitivity coefficient |
| SIGMA | $\left(\frac{1}{K}-1\right)$ | prediction factor |
| K0 | $K_o$ | ballistic constant |
| SPP0 | $\rho$ | relative air density |

-continued

Table Of Definitions

| A | B | |
|---|---|---|
| SVA | $V_a$ | aircraft true airspeed (ft/sec) |
| VM | $V_m$ | muzzle velocity (3300 ft/sec) |
| RRAT | $\dot{R}$ | target range rate (ft/sec) |
| ROUT | R | target range (feet) |
| EGAOA | $\alpha_g$ | gun angle of attack (radians) |
| SVU | p | aircraft roll rate (rad/sec) |
| SVV | q | aircraft pitch rate (rad/sec) |
| SVW | r | aircraft yaw rate (rad/sec) |
| SAZ | $\lambda_t'$ | target tracker antenna azimuth (radians) |
| SEL | $\lambda_e'$ | target tracker antenna elevation (radians) |
| SNZ | $A_w$ | aircraft normal acceleration (ft/sec/sec) |
| TF | $T_f$ | bullet time of flight (sec) |
| VF | $V_f$ | bullet mean relative velocity (ft/sec) |
| TFDOT | $\dot{T}_f$ | rate of change of $T_f$ |
| TN | $T_n$ | sensitivity |
| PR | $P_r$ | precession rate |
| LVDOT | $\dot{\lambda}_e$ | incremental variation of elevation |
| LWDOT | $\dot{\lambda}_t$ | incremental variation of azimuth |

Figure 6A:
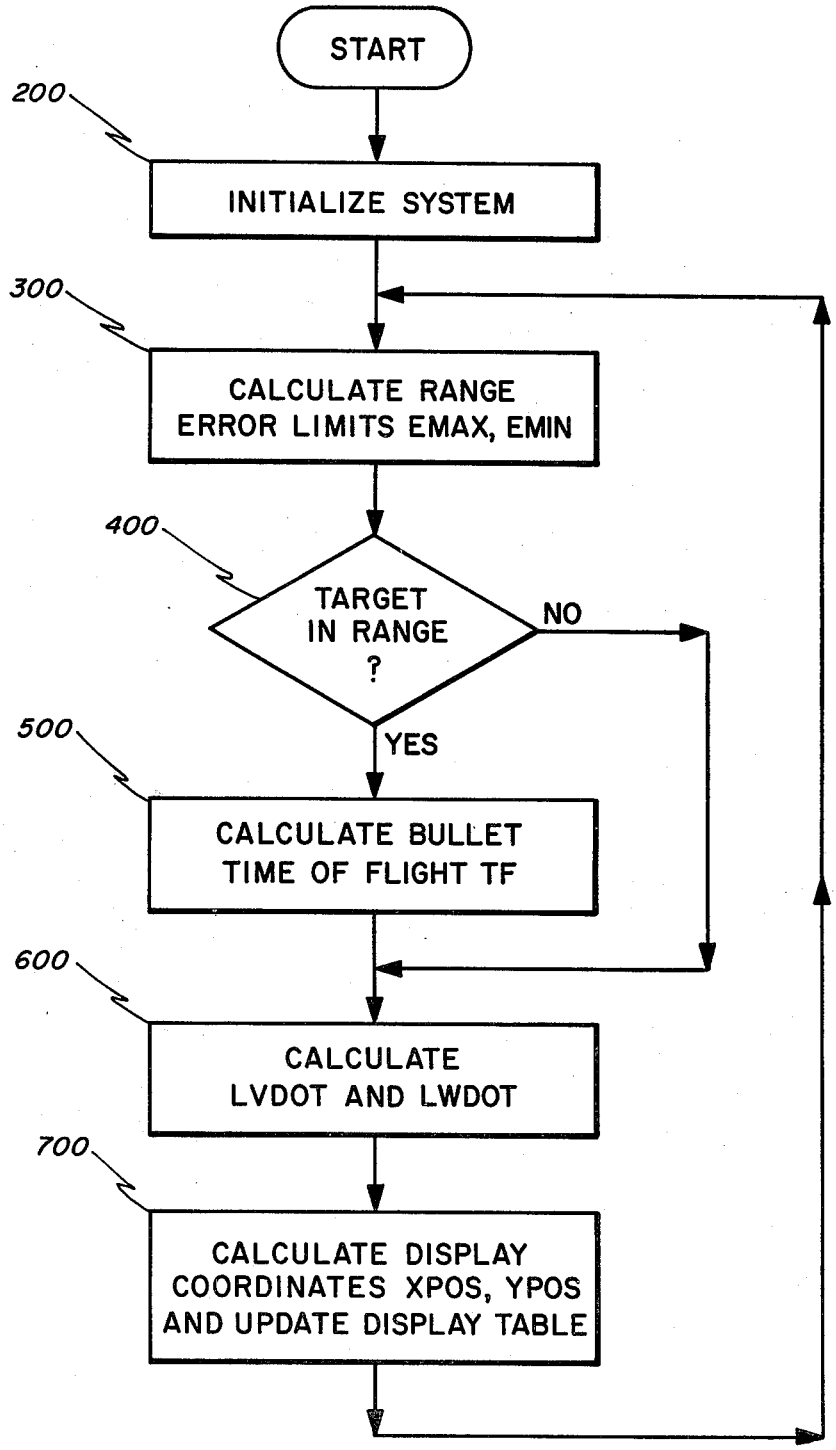

FIG. 6*a* is a schematic flow diagram depicting the overall program for controlling computer 30 to periodically calculate and store in a "display table" portion of its memory the ten values $\lambda_{e1}$ through $\lambda_{e5}$ and $\lambda_{t1}$ through $\lambda_{t5}$. The program comprises an initialized subroutine 200 and five basic subroutines 300–700 which are executed as a repetitive loop with a 20 msec. cycle time.

Figure 6B:
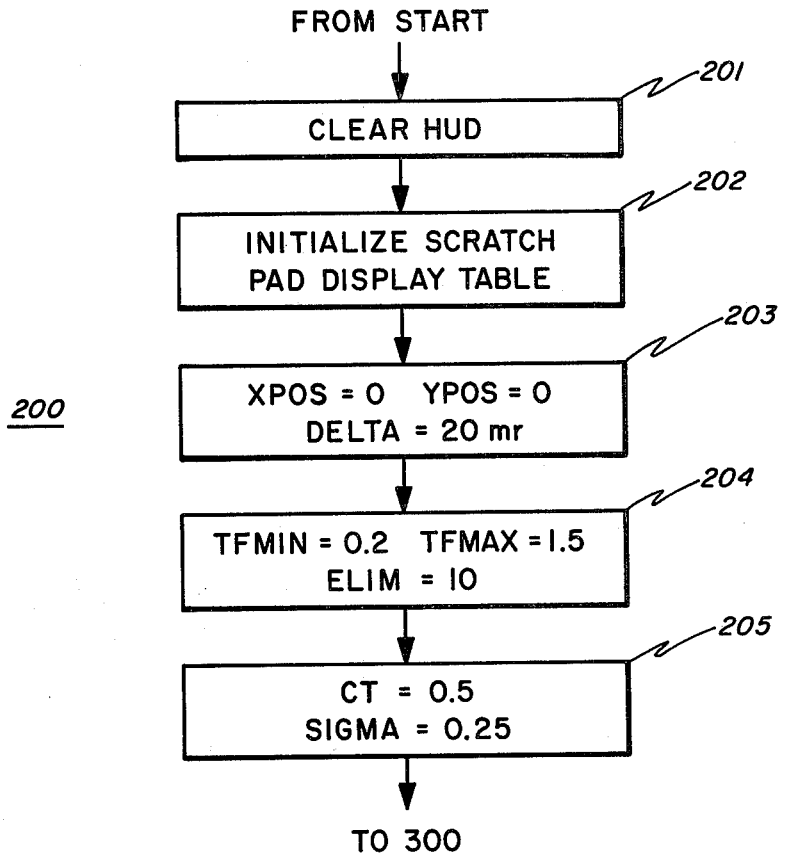

After the program is started by an external signal provided manually by the pilot or by another control input, the initialize subroutine 200 is performed to set the proper constants into the system. As shown in FIG. 6*b*, the initialize subroutine comprises five steps 201–205 which operate respectively to clear the HUD, initialize the scratchpad memory of computer 30 which is used to store the display table, and to enter initial values for XPOS, YPOS, DELTA, TFMIN, TFMAX, ELIM, CT, and SIGMA.

After initialization, subroutines 300 and 400 (FIG. 6*a*) are executed to determine whether the target is in an acceptable range "window" defined by error limits EMAX and EMIN. If the target is not in range the window, i.e., if it is either too close to or too far from the attacking aircraft, subroutine 500 is skipped and subroutine 600 is performed to calculate LVDOT and LWDOT using predetermined values for bullet time of flight TF so that the sighting array is displayed as though the target were at the minimum or maximum range of the firing window. Of course, the pilot will be provided with an "out-of-range" indication or otherwise be prevented from firing the gun under these conditions. However, the sighting array is set up on the display so that it can be utilized by the pilot the instant the target enters the range window.

If subroutine 400 determines that the target is in range, subroutine 500 is executed to calculate the proper value of bullet time of flight TF and thereafter subroutines 600 and 700 are executed to utilize TF to calculate LVDOT and LWDOT. The latter are used in turn to calculate and provide to the display the coordinates $\lambda_{e1}$ through $\lambda_{e5}$ and $\lambda_{t1}$ through $\lambda_{t5}$ which are derived from the center dot coordinates XPOS and YPOS.

On completion of subroutine 700 the program is reentered at subroutine 300 and reexecuted to update the display coordinates. Since subroutines 300 through 700 are executed in repetitive fashion every 20 msec., the sighting array provides the pilot with a continuous display of relative rate information whereby accurate sighting and gun fire control is achieved.

Figure 6C:
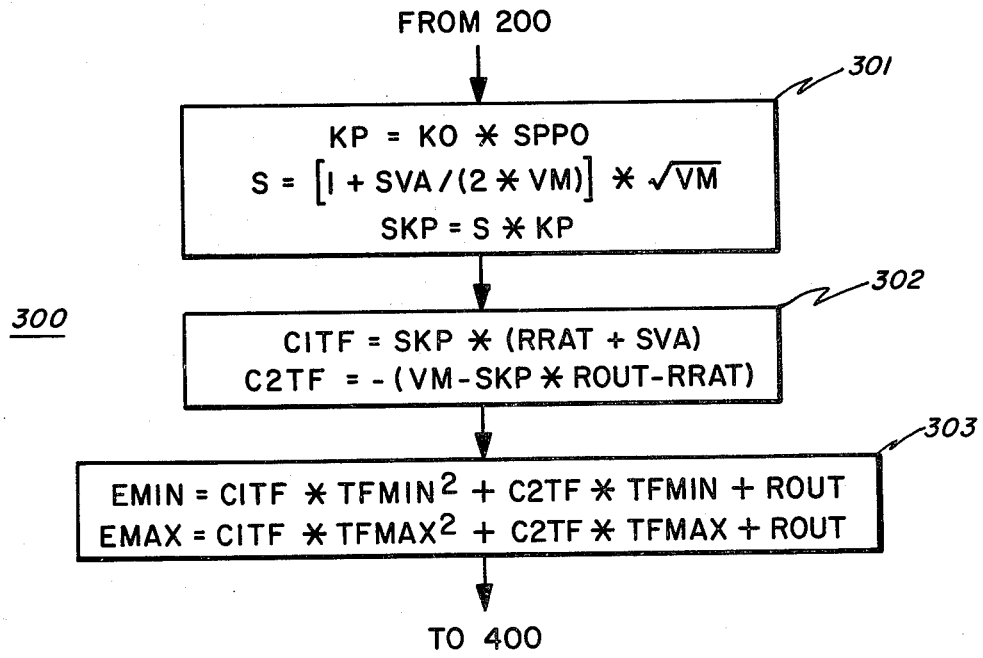

Looking at FIG. 6*c*, the functions of subroutine 300 for calculating the range error limits EMAX and EMIN are disclosed. In accordance with conventional practice, the asterisk symbol (*) represents the multiply function. The purpose of subroutine 300 is to feed the parameters EMIN and EMAX to subroutine 400 based on the prevailing factors of relative air density, aircraft true airspeed, target range and range rate according to the equations of steps 301–303 shown in FIG. 6*c*. Subroutine 400 uses the calculated values of EMIN and EMAX to determine whether the target is in a range window that will yield an acceptable solution to the firing problem then prevailing.

Figure 6D:
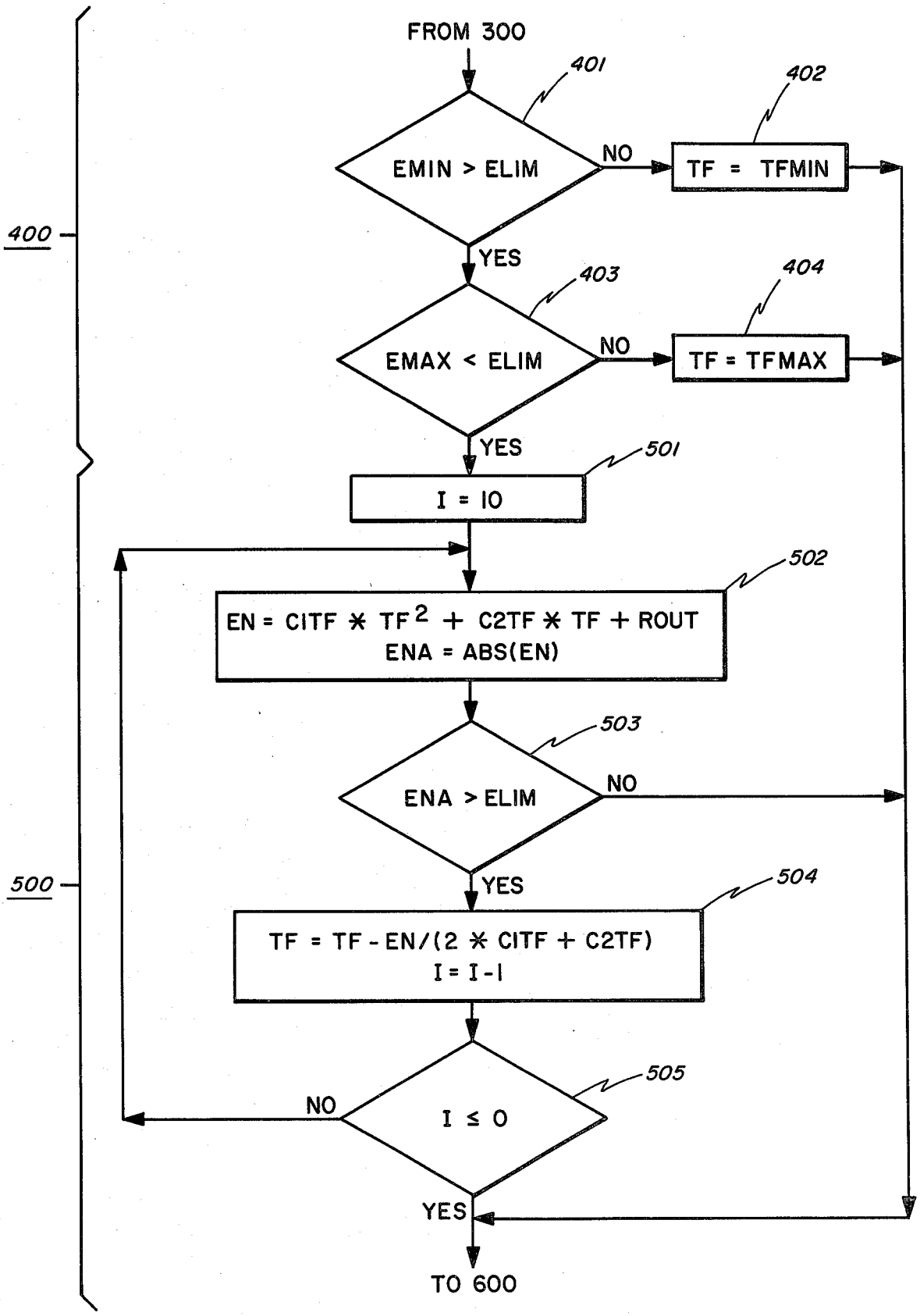

Looking at FIG. 6*d*, it is seen that subroutine 400 first determines whether EMIN is greater than ELIM and if it is proceeds through step 403 to determine whether EMAX is less than ELIM. If the latter is also true, the program then enters subroutine 500 for calculating bullet time of flight TF.

However, if in step 401 EMIN is determined to be less than ELIM the program branches to step 402 where TF is set to the given TFMIN value (e.g., 0.2-see FIG. 6*b*) whereupon control is transferred directly to subroutine 600. Similarly, if in step 403 EMAX was determined to be greater than ELIM, the program branches to step 404 where the given TFMAX value (e.g., 1.5) is inserted for TF and subroutine 600 is entered directly.

Subroutine 500 represents the Newton Raphson approximation for time of flight. In the initial step 501 an iteration counter is set to a count of 10 and thereafter a subloop comprising steps 502, 503, 504, and 505 is executed ten times to develop a value for TF by successive approximation assuming an initial TF value of, for example, 1.5 (maximum) and utilizing the previously calculated factors C1TF, C2TF, and ROUT.

In step 502 the term "ABS" stands for absolute value and ENA represents the absolute value of EN. If during the successive approximation calculation, step 503 determines that ENA is greater than ELIM, the program exits the successive approximation subloop and proceeds directly to subroutine 600 with the then current value of TF being utilized for time of flight.

Figure 6E:
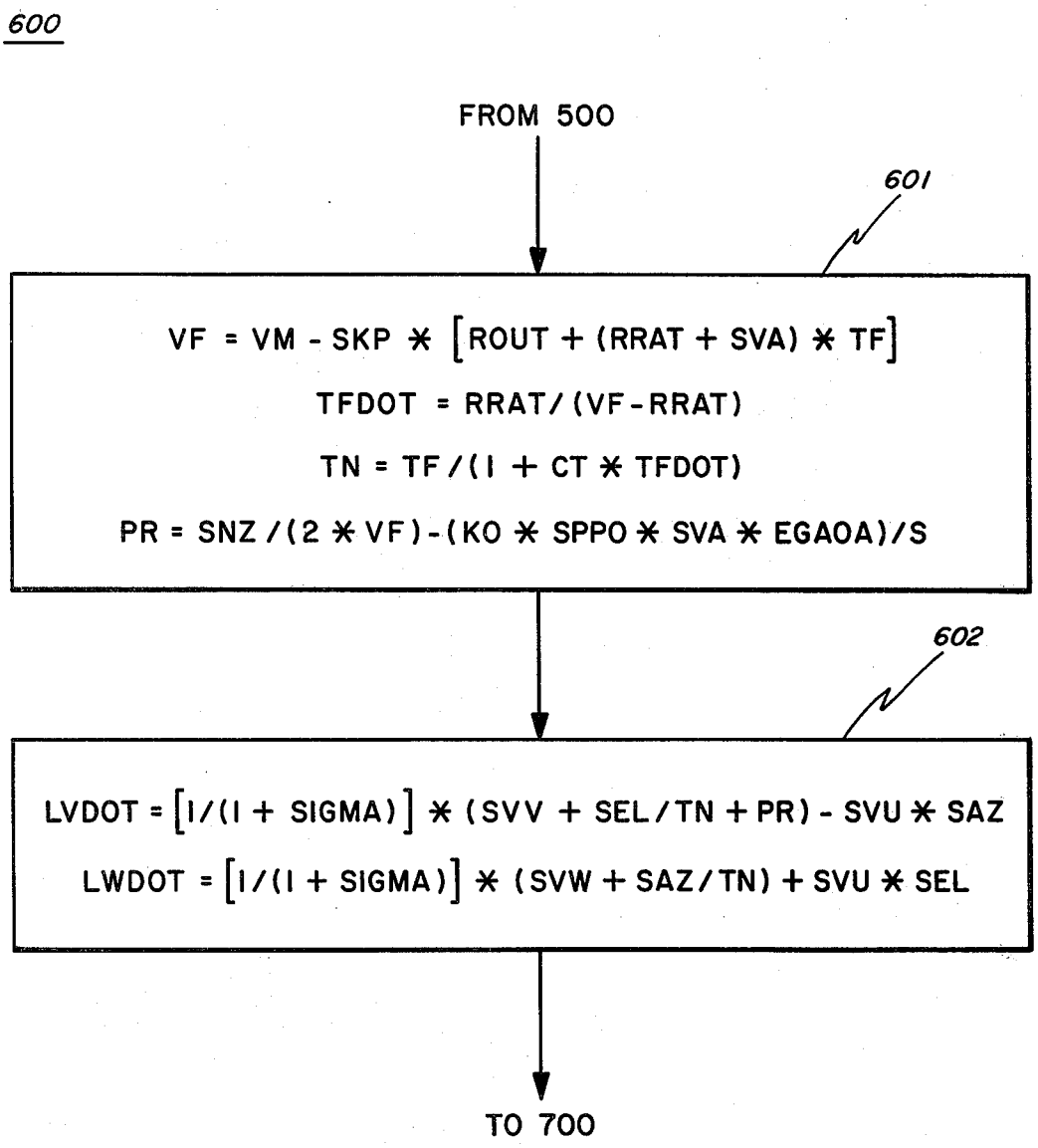

Subroutine 600 shown in FIG. 6*e* implements the previously described basic equations (9) and (10) in the two indicated steps 601 and 602 to calculate values for LVDOT and LWDOT. The latter values are integrated in subroutine 700 to calculate the dot matrix display coordinates. In step 601 values are calculated for bullet mean relative velocity VF, rate of change of TF, sensitivity (TN), and precession rate (PR). These values are then utilized in step 602 to calculate values for LVDOT and LWDOT. It is noted that the equations stated in step 602 are equivalent to previous equations (10) and (9), respectively.

Finally, in subroutine 700 (FIG. 6*f*), values are calculated for XPOS and YPOS, which values are then summed with −SAZ and −SEL, respectively, to determine the absolute difference between the newly calculated center dot coordinates and the actual target coordinates. The absolute difference values are then compared against DELTA in steps 702 and 704 and the value of SAZ or SEL is inserted for either XPOS or YPOS if the absolute difference value is determined to be greater than DELTA.

The new coordinate values XPOS and YPOS are then transferred to the display table in the computer memory, along with updated coordinate values for the other twenty-four dots in the sighting array. Calculation of the remaining twenty-four dot coordinates is done simply by adding the appropriate DELTA increments to the XPOS and YPOS values. For example, looking at FIG. 9, the X coordinate value for dot $d_{11}$ is represented by XPOS−2 DELTA and the Y coordinate is represented by YPOS+2 DELTA (note sign convention indicated in FIG. 3).

The overall program is executed every 20 msec so that updated coordinate values for all twenty-five dots of the sighting array are provided fifty times a second. The dots of the array thus appear to the pilot to move continuously and in unison. Each dot describes the motion of the line of sight to a hypothetical target located at the same range as the actual target and travelling at the velocity and in the direction required to intercept, one bullet flight time later, a bullet fired from the aircraft gun.

FIG. 7 shows the circuits of a hardware implementation of the dot matrix generator 115 which can be employed instead of subroutine 700 (FIG. 6*f*) to produce the ten outputs $\lambda_{e1}$–$\lambda_{e5}$ and $\lambda_{t1}$–$\lambda_{t5}$ to be fed to the symbol generator for controlling the CRT of display unit 24. Circuit 113 (or subroutine 600) provides continuously updated $\dot{\lambda}_e$ and $\dot{\lambda}_t$ signals on lines 114*a* and 114*b*, respectively, representing the value of $\beta$ defining the desired line of sight velocity. Dot matrix generator 115 also receives the $\lambda_e'$ and $\lambda_t'$ target angle signals from the target tracker and timing signals T0–T10 from timing circuit 117.

The dot matrix generator includes a pair of registers 150 and 154 for storing values of the angle coordinates $\lambda_{e3}$ and $\lambda_{t3}$ which define the position of the center dot $d_{33}$ in the dot array D. Registers 150 and 154 have sections 150*t* and 154*t*, respectively, for storing the traverse values $\lambda_{t3}$ and sections 150*e* and 154*e* for storing the elevation values $\lambda_{e3}$. The nomenclature used for the angle coordinate output signals defines the particular dots which are controlled by a given pair of the signals. For example, all dots in the third row of the array have the same elevation component and thus the single elevation coordinate signal $\lambda_{e3}$ is used for generating all five dots in row 3. Likewise, all dots in the third column have the same traverse component and thus the single traverse coordinate output signal $\lambda_{t3}$ is used for generating all five dots in column 3. Together, signals $\lambda_{e3}$ and $\lambda_{t3}$ define the position of center dot $d_{33}$. Any pair of traverse and elevation coordinates combine to produce a dot located at the row position indicated by the e subscript and the column position indicated by the t subscript. For example, $\lambda_{e5}$ and $\lambda_{t1}$ define the location of dot $d_{51}$ (see FIG. 9).

A register 156 is provided for storing values of the line of sight rate components $\dot{\lambda}_t$ and $\dot{\lambda}_e$. Section 156*t* stores the traverse value $\dot{\lambda}_t$ and section 156*e* stores the elevation component value $\dot{\lambda}_e$. A pair of multiplier circuits 158*t* and 158*e* multiply the coordinate values stored in register sections 156*t* and 156*e*, respectively, by a time factor ΔT. For reasons which will be made apparent subsequently, ΔT represents in the present embodiment a time period of 20 ms.

The product $\dot{\lambda}_t \cdot \Delta T$ is fed to one input of adder circuit 152*t* to be summed with the value of the traverse angle coordinate $\lambda_t'$ stored in register 150t. Likewise, the product $\dot{\lambda}_e \cdot \Delta T$ produced by multiplier 158e is fed to one input of adder 152e to be summed with the elevation angle coordinate $\lambda_e'$ stored in register section 150e. The sum values generated by adders 152t and 152e are gated via AND gates A8 and A7, respectively, to be stored in sections 154t and 154e of register 154.

The values of the angle coordinates $\lambda_e'$ and $\lambda_t'$ stored in sections 150e and 150t of register 150 are coupled via lines 153 and 151 to a series of AND gates A9–A13 and A14–A18, respectively. These AND circuits are gated by timing signals T1–T10 in a manner described below to generate the dot matrix drive signals $\lambda_{e1}$–$\lambda_{e5}$ and $\lambda_{t1}$–$\lambda_{t5}$. The elevation coordinate value stored in register section 150e represents the coordinate value $\lambda_{e3}$ and is gated directly to the symbol generator 28 via AND A11. Similarly, the traverse coordinate value stored in register section 150t represents the output signal $\lambda_{t3}$ and is gated directly to the symbol generator via AND A16. The $\lambda_{e3}$ and $\lambda_{t3}$ signals, as mentioned above, define the location of the center dot $d_{33}$ of the array D.

Adding circuits 170, 171, 172, and 173 modify the $\lambda_{e3}$ signal by a 1 or 2 $\delta$ offset value to produce the remaining elevation coordinate outputs $\lambda_{e1}$, $\lambda_{e2}$, $\lambda_{e4}$, and $\lambda_{e5}$. As can be seen from FIG. 9, the value $\delta$ represents the distance between adjacent dots in the array.

Thus, adder 170 substracts $2\delta$ from the $\lambda_{e3}$ value to derive the $\lambda_{e1}$ signal. The $2\delta$ offset value is used because the first row of dots in the array has an elevation coordinate which is $2\delta$ closer to the reference point P (FIG. 3) than the center row of dots. In like manner, adders 171, 172, and 173 apply offset factors of $-1\delta$, $+1\delta$, and $+2\delta$, respecfully, to derive the elevation coordinates $\lambda_{e2}$, $\lambda_{e4}$, and $\lambda_{e5}$, respectively.

In a similar fashion, the $\lambda_{t3}$ value stored in register section 150t is coupled via line 151 to adders 180, 181, 182, and 183, which apply 1 or $2\delta$ offset factors to derive the traverse coordinates $\lambda_{t1}$, $\lambda_{t2}$, $\lambda_{t4}$, and $\lambda$t5.

In order to maintain the dot matrix in a position overlaying the target a periodic redesignation of the center dot $d_{33}$ is necessary. This operation is performed by adders 162t and 162e and comparator circuits 160t and 160e. These circuits monitor the amount by which the coordinate values $\lambda_{e3}$ and $\lambda_{t3}$ exceed the coordinate values $\lambda_e'$ and $\lambda_t'$ representing the position of the target, and when the position of center dot $d_{33}$ moves away from the target center by more than $1\delta$ in either the traverse or elevation direction, the circuits operate to designate a different dot, closer to the target, as the $d_{33}$ center dot. This adjusts the center reference point of the dot array and shifts the outer dimension thereof such that the array as a whole is more nearly centered over the target image. This prevents the dot array from drifting away from the target image and permits the pilot to devote full attention to the sighting operation.

Adder 162t subtracts the present value of the target traverse angle $\lambda_t'$ from the value of the $\lambda_{t3}$ display coordinate. The sign of both input signals is ignored by adder 162t so that the difference, which is applied to an input of comparator 160t, represents an absolute comparison of the two signals. The value $\delta$ is applied to the second input of comparator 160t and the comparator produces a "greater than" signal (>) whenever the output from adder 162t exceeds $\delta$. At all other times a positive signal is present at the "equal to or less than" ($\leqq$) output from the comparator.

When the "greater than" output (>) goes positive, AND A5 at the input of register 150 is conditioned and AND A6 is inhibited. This permits the target traverse angle coordinate $\lambda_t'$ to be gated through AND A5 and entered into register section 150t such that the traverse display coordinate $\lambda_{t3}$ is adjusted to equal the traverse coordinate of the target image.

Adder 162e and comparator 160e monitor the value of elevation coordinate $\lambda_{e3}$ in an identical fashion to that just described for the traverse coordinate and operate to periodically realign the value of $\lambda_{e3}$ with the value of $\lambda_e'$. A single-shot multivibrator 164 and OR circuit O3 are provided to prevent malfunctioning of the circuit under certain conditions, as will be described hereinafter.

FIG. 8 illustrates the timing signals T0–T10 applied to the dot matrix generator 115 to properly control the operation of the circuit and generate the output signals supplied to the symbol generator 28 in the correct sequence for scanning the CRT beam to produce the sighting array D. FIG. 8 shows only a single cycle of the timing signals and it is to be understood that the signals continuously repeat in the illustrated sequence. In the present embodiment, the period of a cycle is 20 ms., which means that the output signals recycle 50 times a second and the dot array is regenerated on the CRT 26 at the same repetition rate.

When the pilot has acquired a target in the field of HUD citing panel 22 and has received an indication that target tracker 38 has properly locked on the target, a reset function activates the sighting display. This generates a reset signal RST which is applied to registers 150, 154, and 156 and to OR circuit O3 (FIG. 7) of dot matrix generator circuit 115. This zeroes the three registers and activates single-shot multivibrator 164 whereupon its output goes negative to inhibit ANDS A4 and A6 for a predetermined short time interval (approximately the duration of timing pulse T0).

When register 150 is zeroed, both comparators 160t and 160e produce "greater than" signals (>) at their outputs (assuming the target is not located within a $1\delta$ radius from the display reference point P). With both comparators producing the (>) output, AND gates A3 and A5 are conditioned and gates A4 and A6 are inhibited.

As soon as T0 goes positive, gates A3 and A5 are activated to load the target angle elevation and traverse coordinates $\lambda_e'$ and $\lambda_t'$ into register sections 150e and 150t, respectively. When T1 and T6 simultaneously go positive an instant later, AND gates A9 and A14 are activated to produce the display coordinate outputs $\lambda_{e1}$ and $\lambda_{t1}$. This generates dot $d_{11}$ in the upper left-hand corner of the array D (FIG. 9). Thereafter, T1 stays positive so that the $\lambda_{e1}$ output remains present while T7 through T10 sequentially activate gates A15 through A18 to sequentially generate output signals $\lambda_{t2}$ through $\lambda_{t5}$. This controls CRT 26 to produce the remaining dots $d_{12}$ through $d_{15}$ of the top row of the array.

Thereafter, T1 shifts negative and T2 shifts positive to activate gate A10, generating $\lambda_{e2}$ which, in conjunction with the sequential activation of gates A14 through A18 by T6 through T10, respectively, generates dots $D_{21}$ through $D_{25}$ of the second row of the array. Subsequent cycling of timing signals T3 through T5 along with the recycling of T6 through T10 generates the third, fourth, and fifth rows of dots.

It is noted that since this first cycle of operation is executed with the actual target coordinates $\lambda_e'$ and $\lambda_t'$ stored in register 150, the sighting array D is generated on the sighting panel 22 with the center dot $d_{33}$ positioned at the center of the target image as shown in FIG. 2.

However, when signal T1 of the initial cycle goes positive, gates A7 and A8 are activated to load the adjusted coordinate values $\dot{\lambda}_e'+(\dot{\lambda}_e \cdot \Delta T)$ and $\lambda_t'+(\dot{\lambda}_t \cdot \Delta T)$ into register sections 154*e* and 154*t*, respectively. On the next occurrence of T0 gates A4 and A6 are activated to load these revised coordinate values into register 150. Gates A3 and A5 are inhibited at this time since the "greater than" (>) output from comparators 160*e* and 160*t* are in an inactive (negative) state.

Thus, during the next 20 ms. cycle of operation, the positions of the dots in array D will be shifted slightly by an amount and in a direction represented by the value of the angular rate signals $\dot{\lambda}_t$ and $\dot{\lambda}_e$. If the aircraft is oriented with the correct lead angle and gun error is zero, the magnitude and direction by which the position of the sighting dot shifts will exactly match the magnitude and direction by which the target shifts in the pilot's field of view. There will thus be no relative movement between the target and the sighting dots. If this condition of zero relative velocity persists long enough for the pilot to perceive the condition (approximately 50–100 cycles or 1–2 seconds), he will know that the lead angle is correct and will be able to commence firing.

If the pilot perceives any relative motion between the target image and any dot in the array, he knows that the aircraft is not positioned at the correct lead angle and must maneuver the aircraft until he nulls the relative motion between the target and the dots of the array.

Figure 6F:
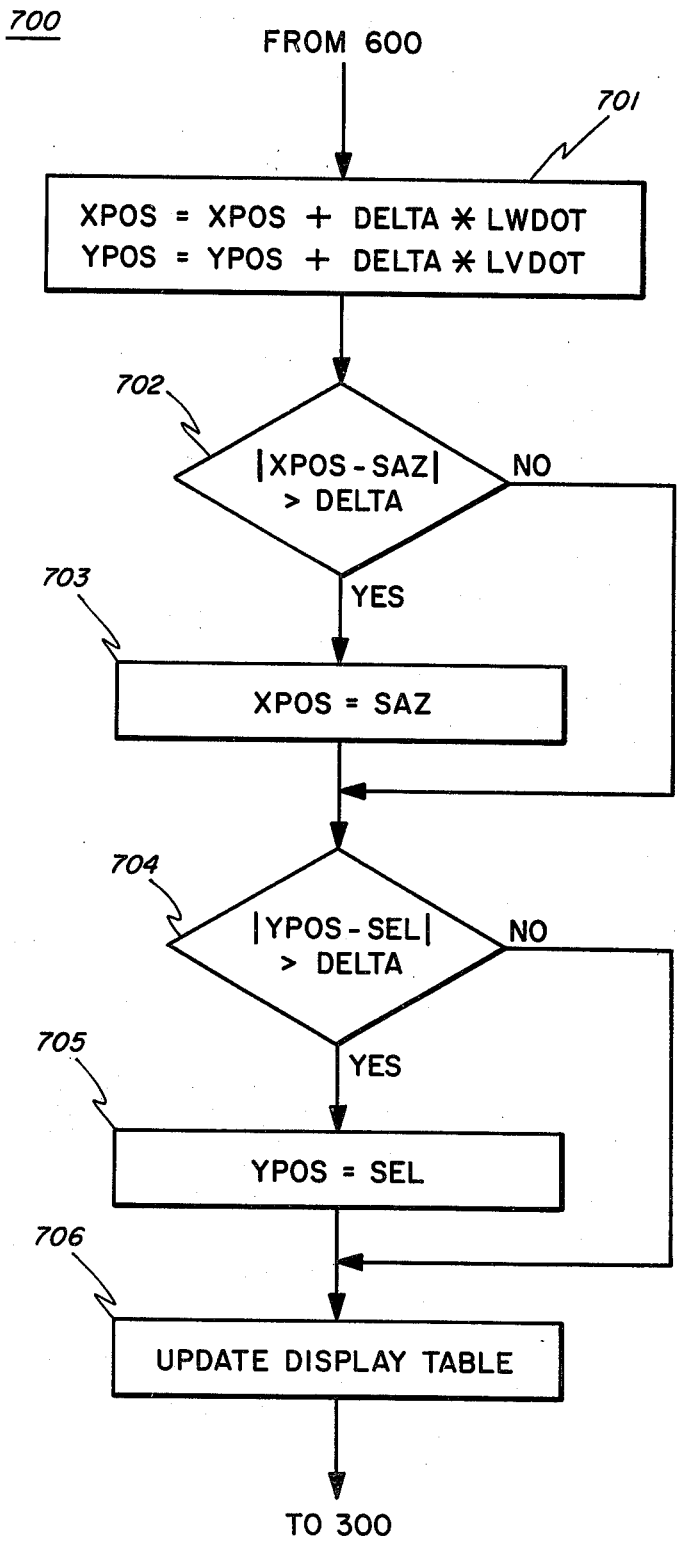

FIGS. 9 and 10 illustrate the manner in which the dot array D is controlled by means of comparators 160*t* and 160*e* or steps 702 and 704 of subroutine 700 (FIG. 6*f*) to maintain the array in a position of alignment with the target image. FIG. 10*a* depicts the initial condition wherein the position of center dot $d_{33}$ (which is designated in FIG. 10*a* as $d'_{33}$) is defined by the actual target angle coordinates $\lambda_e'$ and $\lambda_t'$. In FIG. 10*b*, the condition of the system a short time later is such that the center dot of the array occupies a position $d''_{33}$ located a distance $D_1$ away from the center of the target T. The position of the center dot is now defined by adjusted coordinates $\lambda_e$ and $\lambda_t$, which have been derived through the operation of adders 152*e* and 152*t* (FIG. 7) or step 701 (FIG. 6*f*). However, in the case depicted in FIG. 10*b*, the absolute value of the difference coordinates $\Delta\lambda_e$ and $\Delta\lambda_t$ is less than $\delta$.

Figure 10A:
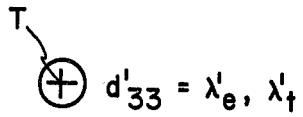
Figure 10B:
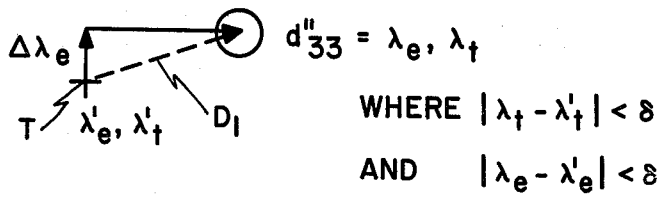
Figure 10C:
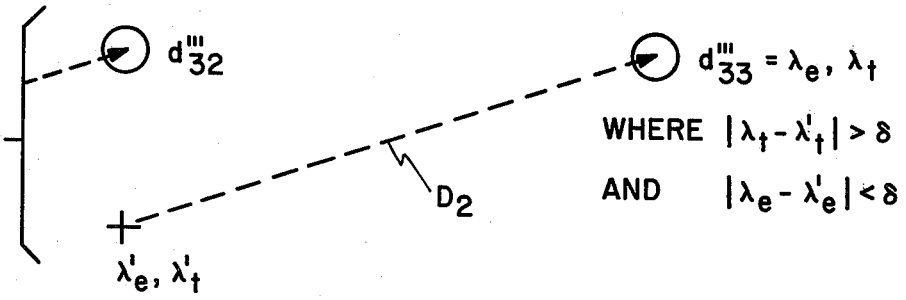
Figure 10D:
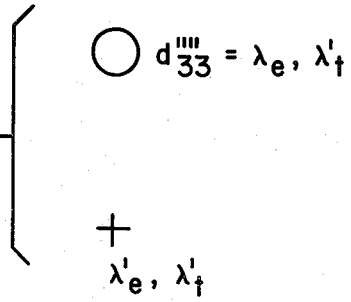

In FIG. 10*c*, the center dot occupies the position $d'''_{33}$ removed by a distance $D_2$ from the actual target coordinates. In this condition, which is also illustrated in FIG. 9, the difference between the traverse coordinate $\lambda_t$ and the corresponding target coordinate $\lambda_t'$ is greater than $\delta$ but the difference in elevation coordinates does not exceed $\delta$. Looking at FIG. 7, comparator 160*t* will respond to this situation by generating a "greater than" (>) output which conditions AND gate A5 and deconditions gate A6. Alternatively, step 702 of subroutine 700 responds with a "yes" and sets XPOS equal to SAZ. Thus, during the next cycle of operation the coordinate value stored in register section 150*t* will be the target traverse coordinate $\lambda_t'$ with the result that during the next cycle of operation the position of the center dot ($d''''_{33}$) is defined by the coordinates $\lambda_e$ and $\lambda_t'$. This is illustrated in FIG. 10*d*.

This shift in the position of the center dot of the array is not perceptable to the pilot who is focusing his attention on the center portion of the array. The new position of dot $d_{33}$ will be virtually identical to the previous position of dot $d_{32}$ (see FIG. 10*c*). In essence, the system has simply redesignated previous dot $d_{32}$ to be the center dot $d_{33}$ for the next series of cycles. When this occurs, a similar redesignation of all the other dots of the array also takes place. The result is that the right-hand column of dots will disappear and a new column of dots will appear at the left-hand boundary of the array. Since these changes in the array structure occur at the outer periphery of the pilot's vision, they do not distract or disrupt his concentration on the target.

The same type of dot realignment will occur whenever the elevation component of the center dot becomes more than 1$\delta$ removed from the elevation component of the target angle. However, in this case the change in the array structure occurs in the top and bottom row of dots. The system, therefore, controls the position of the sighting array such that the target is never displaced by a distance greater than 1$\delta$ from the center dot.

It will be apparent to those skilled in the art that modification and variations can be made in the exemplary system disclosed herein without departing from the scope or spirit of the invention. For example, a sighting array comprising more or less than twenty-five indices and arranged in other than an orthogonal matrix may be employed. Thus, it is intended that the present invention covers those modifications and variations of this invention which come within the scope of the appended claims and their equivalents.

What is claimed is:

1. A method for controlling the gunfire of an aircraft utilizing a headup display comprising the steps of:

maneuvering said aircraft to align a target in said headup display;

projecting a sighting index on said display;

controlling the position of said sighting index on said display so that it appears in the immediate vicinity of said target and moves in the direction and with the velocity that a target appearing at the same relative position on said display would have to have to intercept, one bullet flight-time later, a bullet fired from said aircraft, the motion of said sighting index being defined by the rate of change of traverse and elevation display coordinate angles $\lambda_t$ and $\lambda_e$ as:

$$-\dot{\lambda}_t = K\left(r + \frac{\lambda_t'}{T_n}\right) - p\lambda_e'$$

$$-\dot{\lambda}_e = K\left(q + \frac{A_e'}{T_n} + P_r\right) + p\lambda_t'$$

where $K$ = a constant less than 1 and greater than 0.67
$r$ = yaw rate of said aircraft
$p$ = roll rate of said aircraft
$q$ = pitch rate of said aircraft
$\lambda_t'$ = transverse angle of target line of sight
$\lambda_e'$ = elevation angle of target line of sight
$T_n$ = sensitivity in terms of predicted bullet time of flight
$P_r$ = precession rate $$= \frac{A_w}{2V_f} - \frac{0.00625}{\sqrt{V_m}\left(lt\,\frac{V_a}{2V_m}\right)}\rho V_a \alpha_g$$

where $A_w$ = lift acceleration of said aircraft
$V_f$ = bullet mean velocity relative to said aircraft
$V_m$ = muzzle velocity
$V_a$ = true airspeed of said aircraft
$\alpha_g$ = gun angle of attack
$\rho$ = relative air density additionally maneuvering said aircraft to null the apparent relative motion of said target and said sighting index; and firing said aircraft gun when said relative motion appears to be zero.

2. A method for controlling the gunfire of an aircraft utilizing a head-up display comprising the steps of:

tracking a target located in the field of view of said display to determine the position of said target relative to said aircraft and to generate position signals describing said position;

projecting a first sighting index on said display at a location thereon coincident with said target as viewed in said display; and controlling the position of said first sighting index on said display to move it in accordance with the equation $$\dot{\bar{\beta}} = \frac{\bar{\lambda}'}{T_n} - \frac{\bar{a}_n \times \bar{S}}{2V_f'}$$

where $\dot{\bar{\beta}}$ = angular rate of the line of sight represented by said sighting index
$\bar{\lambda}'$ = position of said target as represented by said position signals
$T_n$ = sensitivity in terms of predicted bullet time of flight
$\bar{a}_n$ = acceleration of said aircraft
$\bar{S}$ = unit vector along line of sight
$V_f'$ = approximate mean bullet relative velocity with respect to said aircraft whereby said first sighting index describes the angular velocity of the line of sight to a hypothetical target located at the range of said target and for which $\bar{\lambda}'$ is the correct lead angle.

3. The method set forth in claim 2 comprising the further steps of:

maneuvering said aircraft to null the velocity of said first sighting index with respect to the velocity of said target on said display, whereby the gun on said aircraft is aimed to achieve a hit on said target.

4. The method set forth in claim 3 comprising the further step of firing said aircraft gun when said velocity null condition is achieved to launch bullets to hit said target.

5. The method set forth in claim 2 wherein:

said step of projecting further includes projecting additional sighting indices on said display at locations thereon adjacent the location of said first sighting index;

and said step of controlling further includes controlling the position of said additional sighting indices in accordance with said equation such that at least one sighting index is always in the immediate vicinity of said target on said display.

6. The method set forth in claim 5 wherein said first sighting index and said additional sighting indices are projected in the form of an n by n array of dots where n is an odd integer and said first sighting index is located in the center of said array.

7. In a system for controlling the gunfire of an aircraft utilizing a head-up display, the combination comprising:

means for tracking a target located within the field of view of said display to determine the position of said target relative to said aircraft, said tracking means further operating to generate position signals describing said positions;

means for projecting a first sighting index on said display at a location thereon coincident with said target as viewed in said display;

means for controlling said projecting means to move said first sighting index relative to said display in accordance with the equation $$\dot{\bar{\beta}} = \frac{\bar{\lambda}'}{T_n} - \frac{\bar{a}_n \times \bar{S}}{2V_f'}$$

where $\dot{\bar{\beta}}$ = angular rate of the line of sight represented by said sighting index
$\bar{\lambda}'$ = position of said target as represented by said position signals
$T_n$ = bullet time of flight
$\bar{a}_n$ = own aircraft acceleration
$\bar{S}$ = unit vector along line of sight
$V_f'$ = approximate average bullet relative velocity with respect to own aircraft whereby said first sighting index describes the angular velocity of the line of sight to a hypothetical target located at the range of said target and for which $\bar{\lambda}'$ is the correct lead angle.

8. The system set forth in claim 7 wherein said controlling means includes further means for controlling said projecting means to project additional sighting indices on said display at locations thereon adjacent the location of said first sighting index, said further means operating to control the position of said additional sighting indices in accordance with said equation such that at least one sighting index is always in the immediate vicinity of said target on said display.

9. The system set forth in claim 8 wherein said controlling means controls said projecting means to project said first sighting index and said additional sighting indices on said display in the form of an n×n array of dots wherein n is an odd integer and said first sighting index is located in the center of said array.

10. A method for controlling the gunfire of an aircraft utilizing a head-up display comprising the steps of;

tracking a target located in the field of view of said display to determine the position of said target relative to said aircraft and to generate position signals describing said position;

projecting a first sighting index on said display at a location thereon coincident with the target as viewed in said display; and controlling the position of said first sighting index on said display such that the motion of said sighting index is defined by the rate of change of traverse and elevation display coordinate angles $\lambda_t$ and $\lambda_e$ as:

$$-\dot{\lambda}_t = K\left(r + \frac{\lambda_t'}{T_n}\right) - p\lambda_e'$$

$$-\dot{\lambda}_e = K\left(q + \frac{\lambda_e'}{T_n} + Pr\right) + p\lambda_t'$$

where K = a constant less than 1 and greater than 0.67

-continued

| | | |
|---|---|---|
| | $r =$ | yaw rate of said aircraft |
| | $p =$ | roll rate of said aircraft |
| | $q =$ | pitch rate of said aircraft |
| | $\lambda_t' =$ | traverse angle of target line of sight |
| | $\lambda_e' =$ | elevation angle of target line of sight |
| | $T_n =$ | sensitivity in terms of predicted bullet time of flight |
| | $P_r =$ | precession rate |
| | $=$ | $\frac{A_w}{2V_f} - \frac{0.00625}{V_m\left(1 + \frac{V_a}{2V_m}\right)} \rho V_a \alpha_g$ |
| where | $A_w =$ | lift acceleration of said aircraft |
| | $V_f =$ | bullet mean velocity relative to said aircraft |
| | $V_m =$ | muzzle velocity |
| | $V_a =$ | true airspeed of said aircraft |
| | $\alpha_g =$ | gun angle of attack |
| | $\rho =$ | relative air density |

whereby said first sighting index describes the angular velocity of the line of sight to a hypothetical target located at the range of said target and for which $\lambda_t'$ and $\lambda_e'$ are the traverse and elevation display coordinate angles of the correct lead angle.

11. The method set forth in claim 10 comprising the further step of:

maneuvering said aircraft to null the velocity of said first sighting index with respect to the velocity of said target on said display, whereby said aircraft gun is aimed to achieve a hit on said target.

12. The method set forth in claim 11 comprising the further step of firing said aircraft gun when said velocity null condition is achieved to launch bullets to hit said target.

13. The method set forth in claim 12 wherein:

said step of projecting further includes projecting additional sighting indices on said display at locations thereon adjacent the location of said first sighting index;

and said step of controlling further includes controlling the position of said additional sighting indices in accordance with said equation such that at least one sighting index is always in the immediate vicinity of said target on said display.

14. The method set forth in claim 13 wherein said first sighting index and said additional sighting indices are projected in the form of an n-by-n array of dots where n is an odd integer and said first sighting index is located in the center of said array.

* * * * *